US007017743B1

(12) United States Patent
Patterson

(10) Patent No.: US 7,017,743 B1
(45) Date of Patent: Mar. 28, 2006

(54) HOLIDAY LIGHT STORAGE AND CARRYING DEVICE

(76) Inventor: Maudeen Patterson, 3350 Columbus, Chicago, IL (US) 60652

( * ) Notice: Subject to any disclaimer, the term of this patent is extended or adjusted under 35 U.S.C. 154(b) by 94 days.

(21) Appl. No.: 10/845,014

(22) Filed: May 14, 2004

(51) Int. Cl.
*B65D 85/42* (2006.01)

(52) U.S. Cl. ..... 206/419; 206/702; 206/408; 242/609.1

(58) Field of Classification Search ..... 206/390, 206/391, 408, 418, 419, 702; 211/26, 113, 211/117; 242/609.1, 405.3, 578.2, 407, 407.1
See application file for complete search history.

(56) References Cited

U.S. PATENT DOCUMENTS 4,917,323 A * 4/1990 Wing ..... 242/405.1
5,033,619 A 7/1991 Garis
5,653,339 A 8/1997 Dobson
5,907,945 A 6/1999 Doyle
6,467,623 B1 * 10/2002 Lewis et al. ..... 206/575
6,557,792 B1 * 5/2003 Snow ..... 242/395.1
6,676,069 B1 * 1/2004 Davis ..... 242/609.1
6,823,993 B1 * 11/2004 Cruze ..... 206/419
6,918,557 B1 * 7/2005 Ast et al. ..... 242/388.6

* cited by examiner

*Primary Examiner*—David T. Fidei
(74) *Attorney, Agent, or Firm*—Crossley Patent Law; Mark A. Crossley

(57) ABSTRACT

A cylindrical devise for storage and carrying of cords, electrical cords, and decorative lights. The device has a round base and a cylindrical snap lock cover with handle. Within are stackable tiers, stackable upon each other and upon the base without regard to a numerical order. Each tier has a shelf and a plug storage socket. The invention enables multiple uses, such as Christmas light storage or item display, and may be simultaneously utilized for dual functions.

15 Claims, 3 Drawing Sheets

HOLIDAY LIGHT STORAGE AND CARRYING DEVICE

BACKGROUND OF THE INVENTION

1. Field of the Invention

This present invention relates to a holiday light storage and carrying device, and more specifically to one for electrical lights and cords, especially holiday decorative lights. The holiday light storage and carrying device also simultaneously provides for cylindrical, multi-tiered display of other objects.

2. Description of the Prior Art

The storage and transport of holiday lights and cords has been a troublesome problem for as long as people have pursued the installation, removal, and storage of the same. What is needed in the field of holiday light storage and carrying devices for decorative lights and the like is an apparatus that is user-friendly, direct, and inexpensive to produce and sell. The proper apparatus should also offer safety in that it should have no sharp edges or the like, so that children may also be involved without worry of injury. It should have no small, removable parts that may endanger children or pets. The apparatus should be lightweight, easily used, and easily stored. Its base should be of a design that allows for stability when lights are removed, stability such that a single user or even a single hand can wrap or unwrap strands. Additionally, the apparatus should have means for separating various strands so that selective storage and removal is easily provided.

A means for anchoring plugs should also be provided, as should a carrying handle for the entire apparatus. Further, an ideal holiday light storage and carrying device should have removable dividers for convenience of separation, reduction in size, or combination of strands. Removable divisions should also provide for other uses. Specifically, an ideal device should lend itself to multiple uses and not be confined to holding cords or light strands. The device should enable attractive coloring, as its primary use may be during festive times and occasions.

Finally, the apparatus should invite usage in the home or in business. All of these features should be available in a design providing for extremely lost cost in manufacturing and sales.

Decorative lights and electrical cord storage and carrying have long been a bane of customer use. Even from manufacturers packaging methods, storage has always been difficult for consumers. Whether for holidays or festive occasions, retrieval from storage, removal from containers, and re-packaging and storing can all be aggravating if not nearly impossible for some. Original packaging has typically been in cardboard and is not designed for easy, repeated use.

Others have, in prior art, offered various attempts at solving this problem.

U.S. Pat. No. 5,033,619 to Garis discloses a light string carrier for holding string lights wrapped about a slotted rectangular interior member. Lights are typically sold wrapped on such a lattice. Such lattice designs are not user-friendly and require effort and time to install and remove light strands. Lattice design is totally omitted from the present invention.

U.S. Pat. No. 5,653,339 to Dobson discloses a box with removable panels around which lights can wrap. This same lattice type design, though, is again not very conducive to ease of use. Two hands and sometimes more are required to manipulate this means, and lights must be arranged throughout the lattice.

U.S. Pat. No. 5,907,945 to Doyle discloses a holiday light storage device that is fairly elaborate in its means for adjustment for varied light spacing along an electrical cord. Again, it is device that requires significant effort for correct usage and is more elaborate than many users may desire.

The above examples and more exist in which manufacturing and uses are involved procedures. In addition, they largely mimic standard lattice, light cord containment and, as such, are what most consumers seek to avoid. The very nature of their complexity also must increase manufacturing costs, thereby elevating sales price. They also do not perform other functions. For example, these devices do not lend themselves to rope or cord storage, nor do they double for any form of display for other items.

While the above-described devices fulfill their respective and particular objects and requirements, they do not describe a holiday light storage and carrying device that provides for the advantages of the present invention.

What is needed in the field of holiday light storage and carrying devices for decorative lights and the like is an apparatus that is user-friendly, direct, and inexpensive to produce and sell. The proper apparatus should also offer safety in that it should have no sharp edges or the like, so that children may also be involved without worry of injury. It should have no small, removable parts that may endanger children or pets. The apparatus should be lightweight, easily used, and easily stored. Its base should be of a design that allows for stability when lights are removed, stability such that a single user or even a single hand can wrap or unwrap strands. Additionally, the apparatus should have means for separating various strands so that selective storage and removal is easily provided.

A means for anchoring plugs should also be provided, as should a carrying handle for the entire apparatus. Further, an ideal holiday light storage and carrying device should have removable dividers for convenience of separation, reduction in size, or combination of strands. Removable divisions should also provide for other uses. Specifically, an ideal device should lend itself to multiple uses and not be simply confined to holding cords or light strands. The device should enable attractive coloring, as its primary use may be during festive times and occasions. Finally, the apparatus should invite usage in the home or in business. All of these features should be available in a design providing for extremely lost cost in manufacturing and sales.

Therefore, a need exists for an improved holiday light storage and carrying device, particularly one for decorative light strands and lights cords and the like. In this respect, the present invention substantially departs from the conventional concepts and designs of the prior art. In doing so it provides for an apparatus primarily designed for the storage and carrying of decorative lights, light cords, and the like that while also providing for alternative and combined functions.

SUMMARY OF THE INVENTION

In view of the foregoing disadvantages inherent in the known types of holiday light storage and carrying devices for decorative lights now present in the prior art, the improved holiday light storage and carrying device overcomes the above-mentioned disadvantages and drawbacks or the prior art. As such, the general purpose of the improved holiday light storage and carrying device, described subsequently in greater detail, is to provide an improved holiday light storage and carrying device which has all of the advantages of the prior art mentioned heretofore and many novel features that result in an improved holiday light storage and carrying device which is not anticipated, rendered obvious, suggested, or even implied by the prior art, either alone or in combination thereof.

To attain this, the present invention comprises a cylindrical storage and carrying device for cords, electrical lights and the like. Its design is not limiting with respect to uses. Virtually any cord, light, rope or the like can be easily wound and unwound from the invention. Further the improved holiday light storage and carrying device provides for all of the aforementioned needs and more that may become obvious upon viewing of the descriptions herewith. Addressed in the invention's design are low cost of manufacturing, ease of use, and, as a further benefit, provision for multiple uses and even combined uses.

In the cylindrical design, the invention contains, under a snap-lock cover, a plurality of cylindrical tiers. Each tier stacks upon another so that they may be removed. The cover is supplied with a handle for carrying the entire invention. The snap-lock cover negates the need for any form of buckles or more complex fastening means, as more complicated fasteners often prohibit use by children or those with hand dexterity issues.

Of importance is that the cylindrical storage created by the tiers is generally sized with a 9-inch interior diameter and 15-inch exterior diameter, so that appropriate space is available for typically sized and even oversized light strands. Light strands may be added or removed with one hand, with the tier either on or off of the accompanying tiers or base of the invention. The overall diameter also provides for a base of sufficient width such that upright stability is enhanced. Further, a male plug receptacle is provided on each tier's interior diameter so that plug storage is convenient and not conducive to strand tangles. Of additional consideration is that the overall height of the invention, generally 30 inches, is sufficient to house a plurality of tiers. Tier shelves provide for easy storage and removal without the need to try to restore light strands to their originally boxed array. Of note, stacking tiers provides for repetitively configured installations, season after season. By beginning with a logical starting point, the user may then progress to the ending strand, if desired, by progressively adding or removing from top to bottom tier or bottom to top tier. Tier shelves also provide for storage or display of other items.

With the generally flexible, preferably plastic cover, the lights are stored safely when not in use, away from breakage, small animals, and children. There are no small removable parts nor sharp edges or angles, for further safety considerations. The plastic construction of the invention provides for lightweight, low cost of manufacture, and also provides for the ability for presentation in a variety of colors, as such devices are typically used for festive occasions. Tier duplication provides for low-cost manufacturing, and also for removing or re-stacking of tiers without regard to order. Covers and interior parts can be marked with a variety of designs, designs for Christmas, Valentine's Day, Halloween, birthdays, or other. Due to this, the invention may be presented as a gift not needing additional wrapping.

As example of multiple uses, the size and design of the invention provides for use as a food tray ensemble. For example, tiers can be added or subtracted for display of hors de'oeuvres, or cheeses or any number of food items. At the same time, light strands may be left on one or more tiers, plugged in, and utilized to further highlight food or other item displays. An added consideration is that the invention may be offered, in a further embodiment, with a taller cover, so that more tiers may be added.

Thus has been broadly outlined the more important features of the holiday light storage and carrying device so that the detailed description thereof that follows may be better understood and in order that the present contribution to the art may be better appreciated.

Numerous objects, features and advantages of the holiday light storage and carrying device will be readily apparent to those of ordinary skill in the art upon reading the following detailed description of presently preferred, but nonetheless illustrative, embodiments of the holiday light storage and carrying device when taken in conjunction with the accompanying drawings. In this respect, before explaining the current embodiments of the holiday light storage and carrying device in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the improved holiday light storage and carrying device. It is therefore important that the claims be regarded as including such equivalent constructions insofar as they do not depart from the spirit and scope of the present invention.

It is therefore an object of the holiday light storage and carrying device to provide a portable storage and carrier for cords, light strands and the like.

It is an additional object of the holiday light storage and carrying device to provide a device that allows for further, multiple uses, such as food display, for example.

Another object of the holiday light storage and carrying device is to provide for extremely low cost of manufacture.

Still another object of the holiday light storage and carrying device is to provide for no small removable parts.

Yet another object of the holiday light storage and carrying device is to provide for no sharp components.

And, an added object of the holiday light storage and carrying device is to require no assembly.

A further object of the holiday light storage and carrying device is to provide for child safety.

And, it is an object of the holiday light storage and carrying device to provide a device that may be easily used by a child.

Still a further object of the holiday light storage and carrying device is to provide for pet safety.

A significant object of the holiday light storage and carrying device is to provide easy use.

Another object of the holiday light storage and carrying device is to provide for single-handed use.

An additional object of the holiday light storage and carrying device is to provide an easy means for latching the cover to the base.

A further object of the holiday light storage and carrying device is to provide multiple tiers within the invention.

Still another object of the holiday light storage and carrying device is to provide removable tiers.

Also, it is an object of the holiday light storage and carrying device to provide stackable tiers.

A further object is of the holiday light storage and carrying device is to provide tiers that stack without regard to order.

An added object of the holiday light storage and carrying device is to provide a device that is a package in itself.

It is a further object of the holiday light storage and carrying device to provide an easy carry handle.

Also, it is an object of the holiday light storage and carrying device to provide sufficient base width to insure upright integrity.

Further, it is an object of the holiday light storage and carrying device to provide a device that is useful in home or business.

Yet another object of the holiday light storage and carrying device is to provide for light storage so that a simple removal of stored strands, in reverse order, provides for duplication of prior arrangement.

It is a further object of the holiday light storage and carrying device to provide storage for strands which discourages any tangling.

An additional object of the holiday light storage and carrying device is to provide storage that minimizes light breakage.

Still another object of the holiday light storage and carrying device is to provide for plug storage.

Another object of the holiday light storage and carrying device is to provide sufficient space for typical strand storage within one tier.

Still an added object of the holiday light storage and carrying device is to provide sufficient space for storage or an over-sized strand within a tier.

It is another object of the holiday light storage and carrying device to provide a device that can be used simultaneously for more than one task.

An added object of the holiday light storage and carrying device is light weight.

Still a further object of the holiday light storage and carrying device is to provide for manufacture from plastic, plastic cast, or injection molding.

An additional object of the holiday light storage and carrying device is to provide for manufacture that is conducive to colorful presentation.

These together with additional objects of the holiday light storage and carrying device, along with various novel features that characterize the invention are particularly pointed out in the claims forming a part of this disclosure. For better understanding of the improved holiday light storage and carrying device, it operating advantages and specific objects attained by its uses, refer to the accompanying drawings and description.

DETAILED DESCRIPTION OF THE DRAWINGS

With reference now to the drawings, and in particular FIGS. 1 through 4 thereof, the preferred embodiment of the improved holiday light storage and carrying device employing the principles and concepts of the present invention and generally designated by the reference number 10 will be described.

Figure 1:
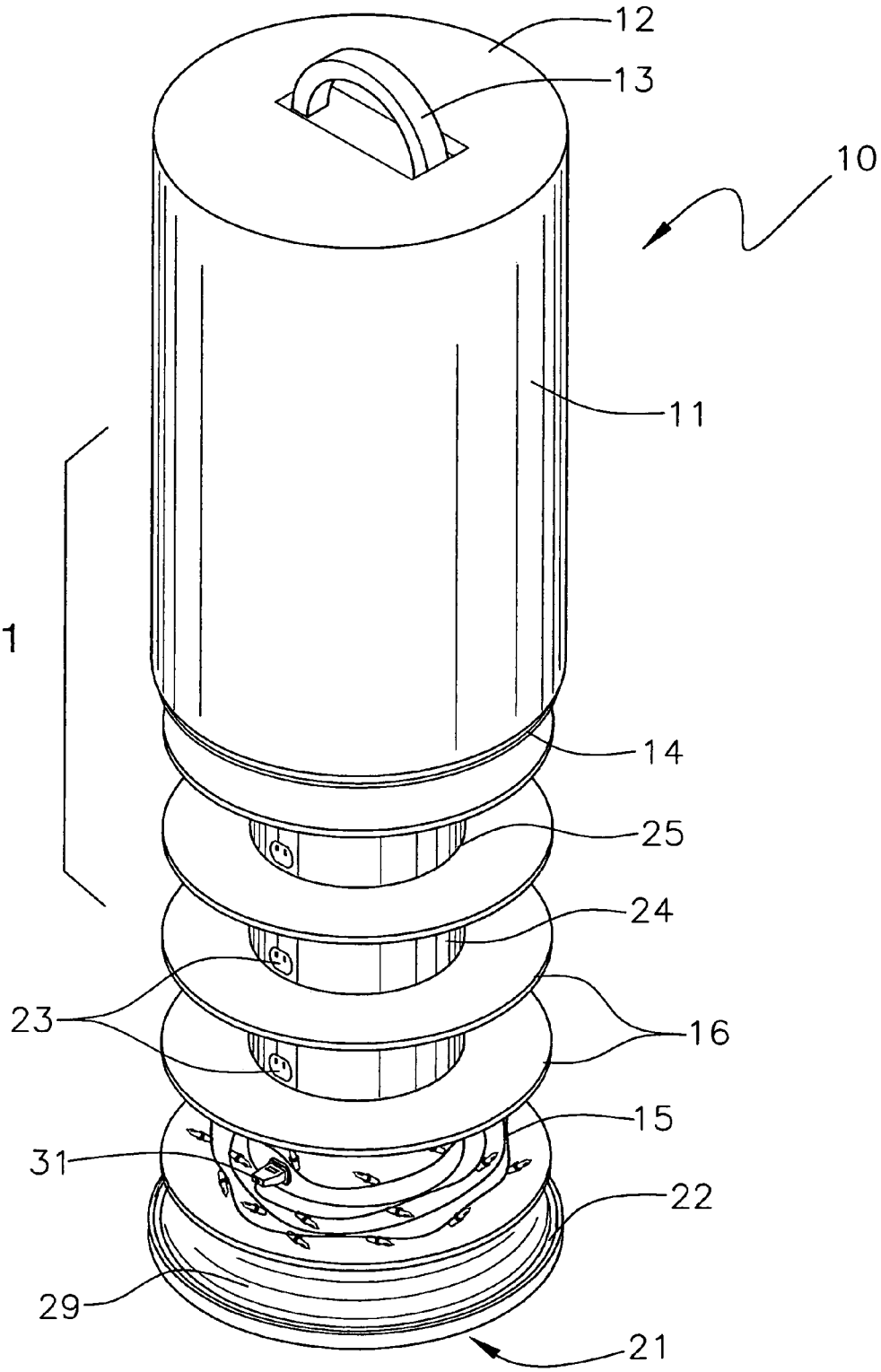
FIG. 1 is a perspective view of the invention with ornamental lights on the lower tier, the cover partially removed.

Referring to FIG. 1, the invention 10 comprises a holiday light storage and carrying device with a round base 21. The snap groove 22 is immediately proximal to the outer perimeter of the base 21. The conical member 29 slants upwardly from the edge of the snap groove 22. The outer diameter of the conical member 29 begins at the inner diameter of groove 22. A first tier 30 (FIG. 2) is fitted atop the round base 21. A plurality of tiers 30 are stacked atop each other. The cylindrical cover 11 removably fits around the tiers 30. The round cover lid 12 atop cylindrical cover 11 is upwardly affixed with the handle 13. The handle 13 is slightly recessed within the round cover lid 12 such that the handle 13 is more easily grasped. The snap ring 14 is disposed at the bottom of the cylindrical cover 11. The snap ring 14 removably fits within the snap groove 22. Snap groove 22 is disposed at the outer perimeter of the round base 21. The flexibility of the cylindrical cover 11 and snap ring 14 provide for flex such that the snap ring 14 is inserted and affixed within the snap groove 22. The flexibility of the cylindrical cover 11 and the snap ring 14 also provide for removal of the snap ring 14 from the snap groove 22. A light strand 15 is wound about the outer surface of outer sleeve section 24 of the lowest tier 30. The electrical plug 31 of the light strand 15 is removably inserted into the plug storage socket 23 of the lowest tier 30. The light strand 15 rests upon the shelf 16 of the lowest tier 30. Each shelf 16 is circular and in the horizontal plane. The interior limit of the shelf 16 abuts the outer surface of outer sleeve section 24 of each tier 30.

Figure 2:
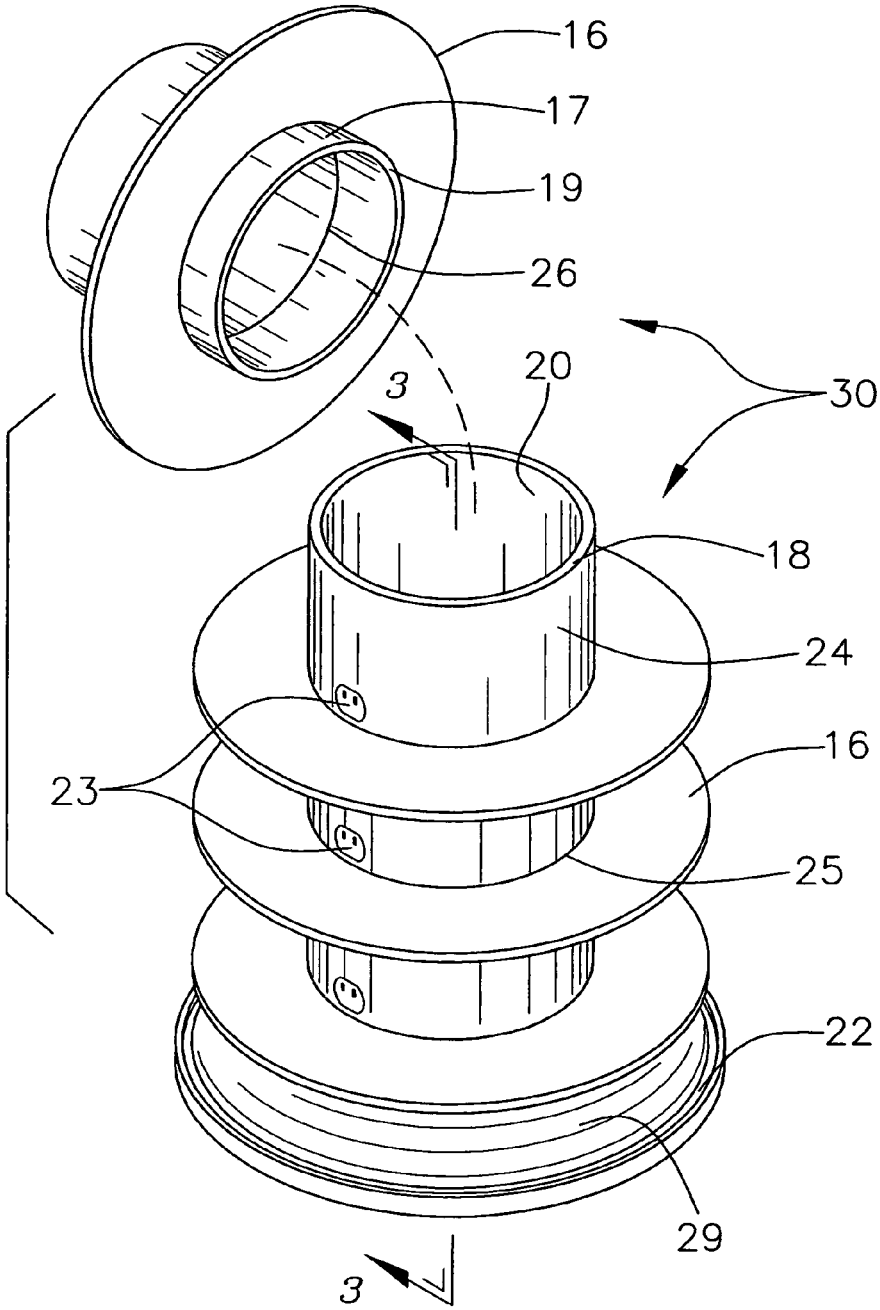
FIG. 2 is a perspective view of the internal tiers of the invention and of the base.

Referring to FIG. 2, the upper tier 30 is removed from the tier 30 immediately below. The inner sleeve section 19 removably fits within the outer sleeve section 18. The outer surface of the inner sleeve section 17 slides against the inner surface of the outer sleeve section 20. The juncture of inner sleeve section 19 with outer sleeve sections 18 forms a step. The shelf 16 of an upwardly disposed tier 30 rests upon the outer sleeve section 18 of the next lower tier 30. Tiers 30 are thereby stackable. The outer surface of outer sleeve section 24 is comprised of a plug storage socket 23.

Figure 3:
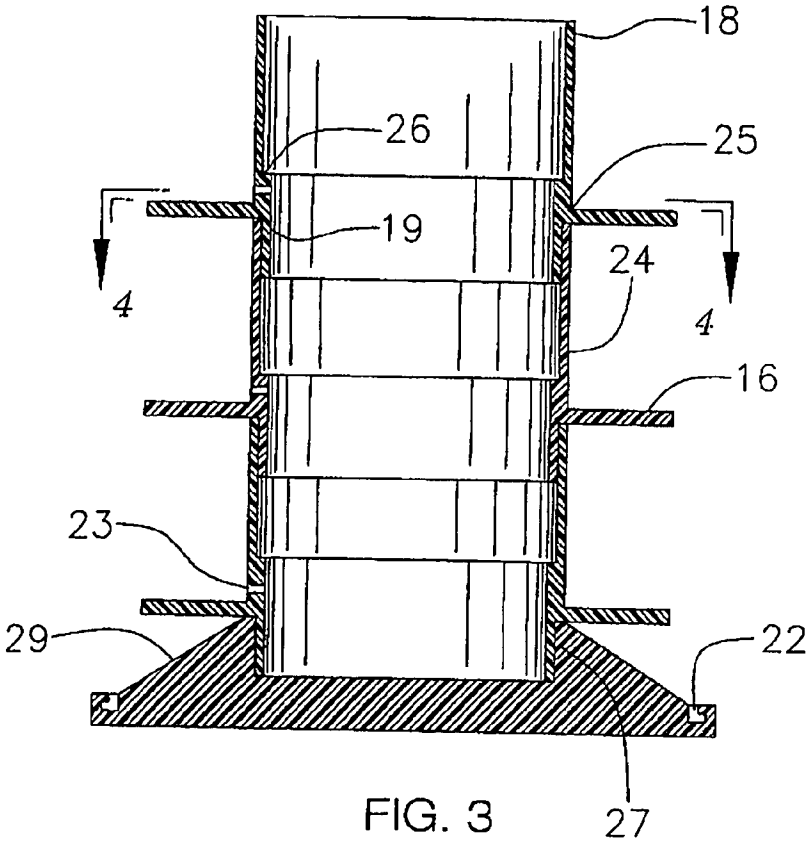
FIG. 3 is a lateral cross sectional view of the tiers and base of the invention of FIG. 2, taken along the line 3—3.

Referring to FIG. 3, the conical member 29 begins at the inner perimeter of the snap groove 22. The conical member 29 slants upwardly to end at the base vertical sleeve 27. The base vertical sleeve 27 is disposed at the inner perimeter of the conical member 29. The base vertical sleeve 27 forms a cylindrical pocket for the removable receipt of a tier 30. The base vertical sleeve 27 receives the inner sleeve section 19 of a tier 30. Any tier 30 fits within the base 21 to form the first removable tier 30. The inner perimeter of the conical member 29 is upwardly abutted by the shelf 16 of an upwardly and removably disposed tier 30. Each tier 30 is comprised of a plug storage socket 23. The plug storage socket 23 is proximally above the shelf 16 of each tier 30. The inner sleeve section 19 of an upwardly disposed tier 30 removably fits within an outer sleeve section 18 of the next lower tier 30.

Figure 4:
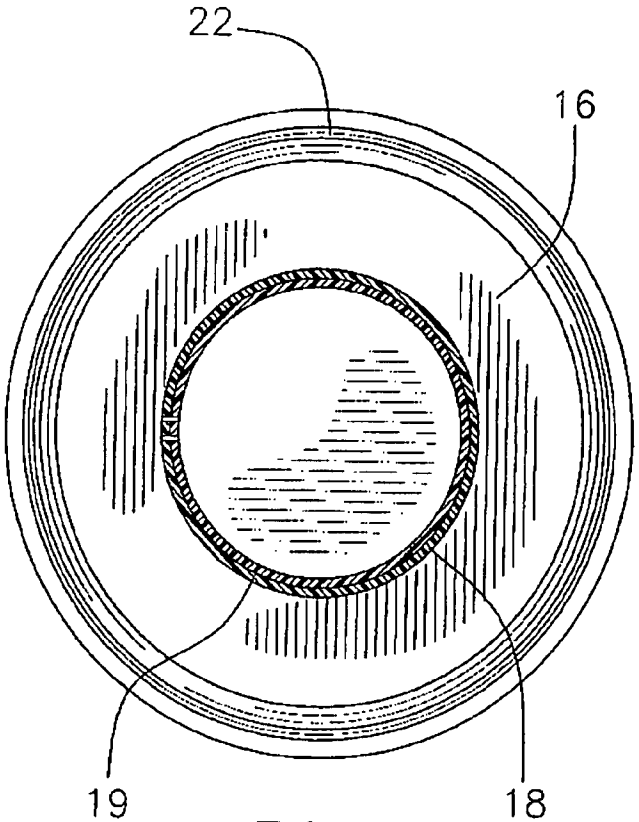
FIG. 4 is a top plan view of FIG. 3 taken along the line 4—4.

Referring to FIG. 4, an outer perimeter of a shelf 16 of a tier 30 is disposed above and medial to the snap groove 22. The inner sleeve section 19 is within the outer sleeve section 18.

In storing a light strand 15, electrical plug 31 is plugged into plug storage socket 23. The light strand 15 is then wound around the outer surface of outer sleeve section 24. When chosen, plug 31 may be taken from socket 23 and plugged into a wall socket (not shown) to energize light strand 15 while strand 15 is still in place on chosen tier 30. Any light strand 15 is removed and added to a tier 30 as chosen. Tiers 30 are limited only by the size of a given light stand 15. Multiple light strands 15 may be wound around a tier 30 as chosen. Light strands 15 are totally removed and added as chosen. Tiers 30 are stacked in any order chosen. The cylindrical cover 11 is removed and added to the round base 21 as chosen. Manually flexing the side of the cylindrical cover 11 provides the flex needed for the snap ring 14 to be released from the snap groove 22. The cylindrical cover 11 is affixed to the round base 21 by pushing downwards. The snap ring 14 thereby temporarily locks into the snap groove 22.

With respect to the above description then, it is to be realized that the optimum dimensional relationships for the parts of the improved holiday light storage and carrying device, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A holiday light storage and carrying device comprising:
a round base;
a conical member of the round base, the conical member beginning proximal to an outer perimeter of the round base and slanting upwardly and medially;
a base vertical sleeve centrally disposed within the round base, the base vertical sleeve beginning at an inner perimeter of the conical member, the base vertical sleeve forming a pocket;
a plurality of round identical stackable tiers, each tier removably stacking upon the next tier;
a vertical sleeve section of each tier, a portion of each sleeve section removably fitting within the pocket of the round base;
a horizontal circular shelf emanating outwardly from the sleeve section of each tier;
a cylindrical cover covering the plurality of tiers and a substantial portion of the base;
a round cover lid covering the cylindrical cover;
latching means for removably latching the cylindrical cover to the round base.

2. The invention in claim 1 wherein the round cover lid is further comprised of a centrally disposed handle in a top of the round cover lid.

3. The invention in claim 2 wherein the handle is partially recessed within the round cover lid top.

4. The invention in claim 2 wherein the handle is partially recessed within the round cover lid top.

5. A holiday light storage and carrying device comprising:
a round base;
a conical member of the round base, the conical member beginning proximal to an outer perimeter of the round base and slanting upwardly and medially;
a base vertical sleeve centrally disposed within the round base, the base vertical sleeve beginning at an inner perimeter of the conical member, the base vertical sleeve forming a pocket;
a plurality of identical stackable tiers, each tier removably stacking upon the next tier;
a sleeve section of each tier, a portion of each sleeve section removably fifting within the pocket of the round base;
a horizontal circular shelf emanating outwardly from the sleeve section of each tier;
a cylindrical cover covering the plurality of tiers and a substantial portion of the base;
a round cover lid covering the cylindrical cover;
latching means for removably latching the cylindrical cover to the round base;
an electrical plug within each sleeve section, the electrical plug for the removable receipt of typical plug prongs.

6. The invention in claim 5 wherein the electrical plug is disposed immediately above the shelf.

7. The invention in claim 6 wherein the round cover lid is further comprised of a centrally disposed handle in a top of the round cover lid.

8. The invention in claim 7 wherein the handle is partially recessed within the round cover lid top.

9. The invention in claim 8 wherein the cylindrical cover and round base are flexible;
a snap ring disposed at a lower edge of the cylindrical cover;
a snap groove disposed at an outer perimeter of the round base,
such that the snap ring is removably inserted into the snap groove.

10. A holiday light storage and carrying device comprising:
a round base;
a conical member of the round base, the conical member beginning proximal to an outer perimeter of the round base and slanting upwardly and medially;
a base vertical sleeve centrally disposed within the round base, the base vertical sleeve beginning at an inner perimeter of the conical member, the base vertical sleeve forming a pocket;
a plurality of identical stackable tiers;
an inner sleeve section of each tier;
an outer sleeve section of each tier, the outer sleeve section joined to a top of the inner sleeve section, each inner sleeve section removably fitting within the outer sleeve section of an identical tier, each inner sleeve section of a tier removably fitting within the pocket of the round base;
a horizontal circular shelf emanating outwardly from the junction of the inner sleeve section and the outer sleeve section of each tier;
a cylindrical cover covering the plurality of tiers and a substantial portion of the base;
a round cover lid covering the cylindrical cover;
latching means for removably latching the cylindrical cover to the round base.

11. The invention in claim 2 wherein the cylindrical cover and round base are flexible;
a snap ring disposed at a lower edge of the cylindrical cover;
a snap groove disposed at an outer perimeter of the round base,
such that the snap ring is removably inserted into the snap groove.

12. The invention in claim 3 wherein each outer sleeve section comprises an electrical plug, the electrical plug for the removable receipt of typical plug prongs.

13. The invention in claim 4 wherein the electrical plug is disposed proximal to and above the shelf.

14. The invention in claim 5 wherein the round cover lid is further comprised of a centrally disposed handle in a top of the round cover lid.

15. The invention in claim 6 wherein the handle is partially recessed within the round cover lid top.

* * * * *